United States Patent [19]

Koch

[11] 4,114,610

[45] Sep. 19, 1978

[54] KNEE BENDING DEVICE

[76] Inventor: Guido Koch, Andreasstrasse 15, 6580 Idar-Oberstein, Germany

[21] Appl. No.: 761,201

[22] Filed: Jan. 21, 1977

[51] Int. Cl.[2] ..... A61H 1/02

[52] U.S. Cl. ..... 128/25 R

[58] Field of Search ..... 128/25 R, 33, 25 B; 297/434

[56] References Cited

U.S. PATENT DOCUMENTS

| | | | |
|---|---|---|---|
| 156,004 | 10/1874 | Wayland | 297/434 |
| 347,321 | 8/1886 | Clarke | 297/434 |
| 4,012,074 | 3/1977 | O'Reilly et al. | 297/434 |

FOREIGN PATENT DOCUMENTS

| | | | |
|---|---|---|---|
| 996,142 | 6/1965 | United Kingdom | 297/434 |

*Primary Examiner*—Lawrence W. Trapp

*Attorney, Agent, or Firm*—Webb, Burden, Robinson & Webb

[57] ABSTRACT

A knee bending device for patients having stiff legs comprises a chair having a tubular metal frame supporting a seat, back support and arm rests. A U-shaped stirrup having two parallel limbs and a connecting central bar has its limbs pivotally mounted at respective arm rests so that the free ends of the limbs extend above the arm rests to form levers by which a patient seated in the chair can swing the stirrup back and forth with his hands. As the levers are pressed forward, the connecting bar moves rearwardly to contact the top of the patient's foot. Further forward movement of the levers will result in the patient's foot being pressed back to bend his leg at the knee.

8 Claims, 5 Drawing Figures

Fig.2
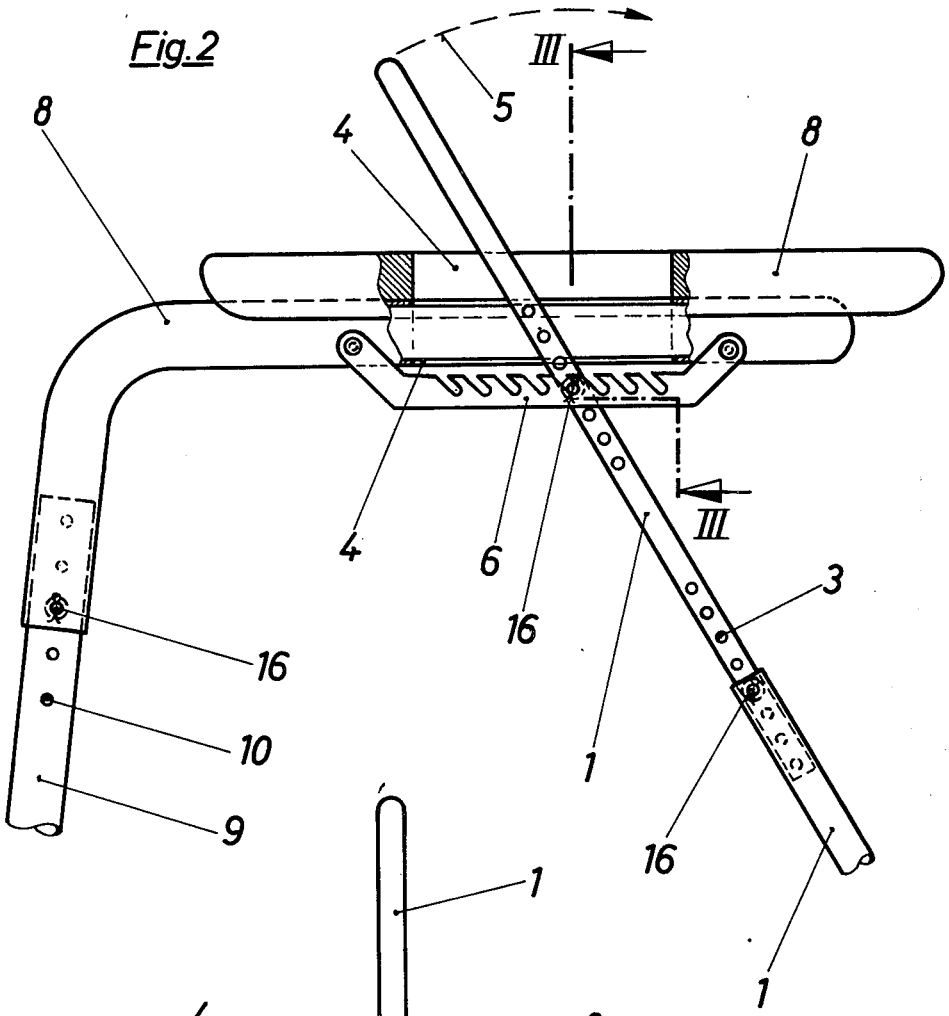
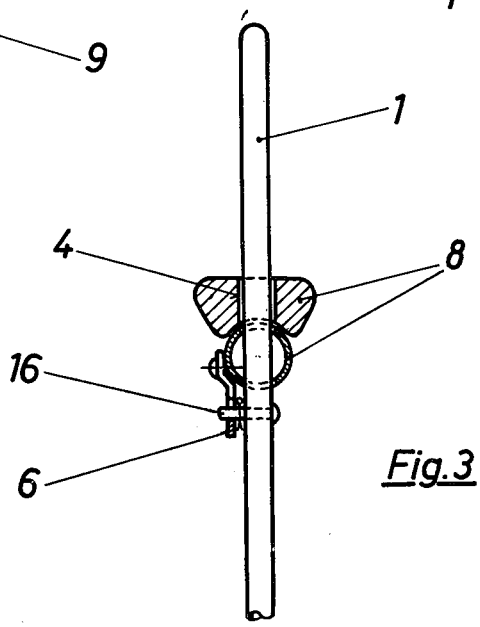
Fig.3

Fig.4
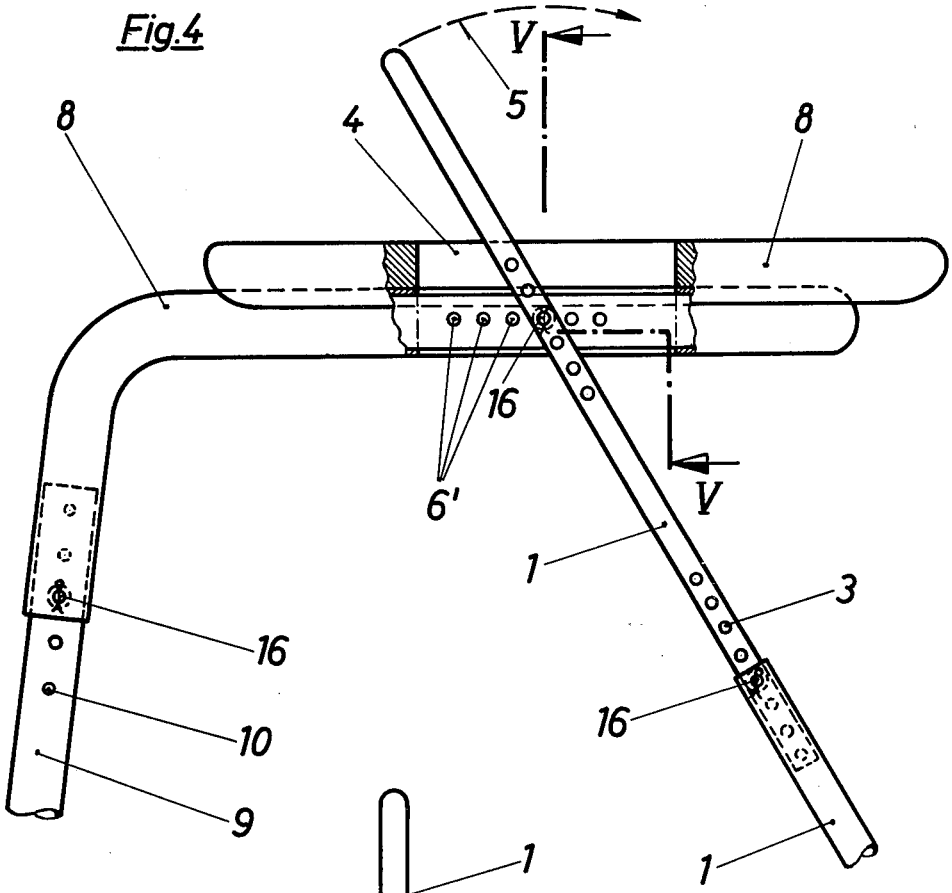
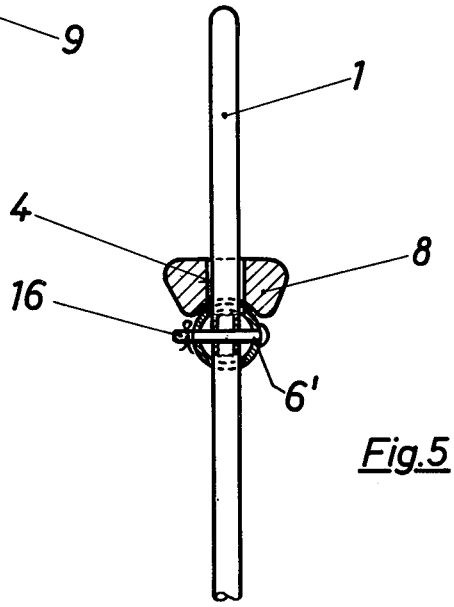
Fig.5

KNEE BENDING DEVICE

This invention concerns a knee bending device.

Through U.S. Pat. No. 2,058,563 a device has become known which serves to strengthen weakened and injured leg muscles of those persons who want to obviate a muscle atrophy caused by an accident to the leg and the operation after-effects bound up therewith. The said previously-known device consists merely of a frame which is to be set down on a table edge and onto which the patient lets himself down on the buttock of the weakened leg. Hingedly fastened to the front edge of this frame, which is held fast on the table surface by the weight of the patient, is a U-shaped swivel stirrup which can be grasped by hand at its two upper ends and be swung back and forth. In the lower part of this U-shaped swivel stirrup, the foot is supported either with the aid of a special shoe or with the aid of a bandage and is connected securely to the control part of the swivel stirrup. The patient is connected, by a belt slung around the hip, to the frame on which he is seated. Then the patient swings, with his own hands, the swivel stirrup into the desired position and then fixes this by two retaining straps which loop around the upper ends of the swivel stirrup. The hinge connection of the swivel stirrup and of the frame are provided with a crank gear which acts perpendicularly upwards and downwards and through the actuation of which the patient can perpendicularly adjust the swivel axis to a slight extent, whereby the knee of the leg up till then stiff on account of the after-effect of the operation can be bent and be straightened. In addition to the disadvantage that this requires a great expenditure of time, only small angles of bend are achievable. Furthermore, this device it has the disadvantage that the structure is complicated and copious. The foot of the patient must initially be fastened in the swivel stirrup and therefore necessitates a corresponding fastening device. Then the frame positioned on the table has to be provided with a fastening belt for the patient and two fastening belts for the two ends of the stirrup.

An object of the present invention is to provide a knee bending device which avoids the said disadvantages and combines the advantages of a simple construction, a simple mode of operation and large angles of bend.

With this object in view, the present invention provides a knee bending device comprising a chair including a back support and arm rests, and provided with a hand-actuated U-shaped pivotally mounted stirrup including two substantially parallel limbs and a connecting central bar, said parallel limbs being swingable about pivots which are adjustably mounted in said arm rests.

The parallel limbs of the swivel stirrup can engage through elongate holes of the arm-rests.

In one embodiment, the arm-rests can each be provided with a stop rail having a plurality of slots into which the pivots selectively engage.

In another embodiment, the arm-rests can have several apertures for selectively receiving the pivots.

Preferably the parallel limbs of the stirrup are adjustable in length.

However, also the chair legs and/or arm-rest supports can be adjustable in height.

Advantageously the central part of the stirrup is provided with a padding to protect the top of the user's foot.

Two embodiments of the invention will be described further, by way of example, with reference to the accompanying drawings, in which:-

FIG. 2 shows a partial side view of an embodiment with a stop rail;

FIG. 3 shows a section along the line III—III of FIG. 2;

FIG. 4 shows a partial side view of another embodiment in which the stop rail of FIG. 3 is replaced by apertures in the arm-rest; and FIG. 5 shows a section along the line V—V of FIG. 4.

Figure 1:
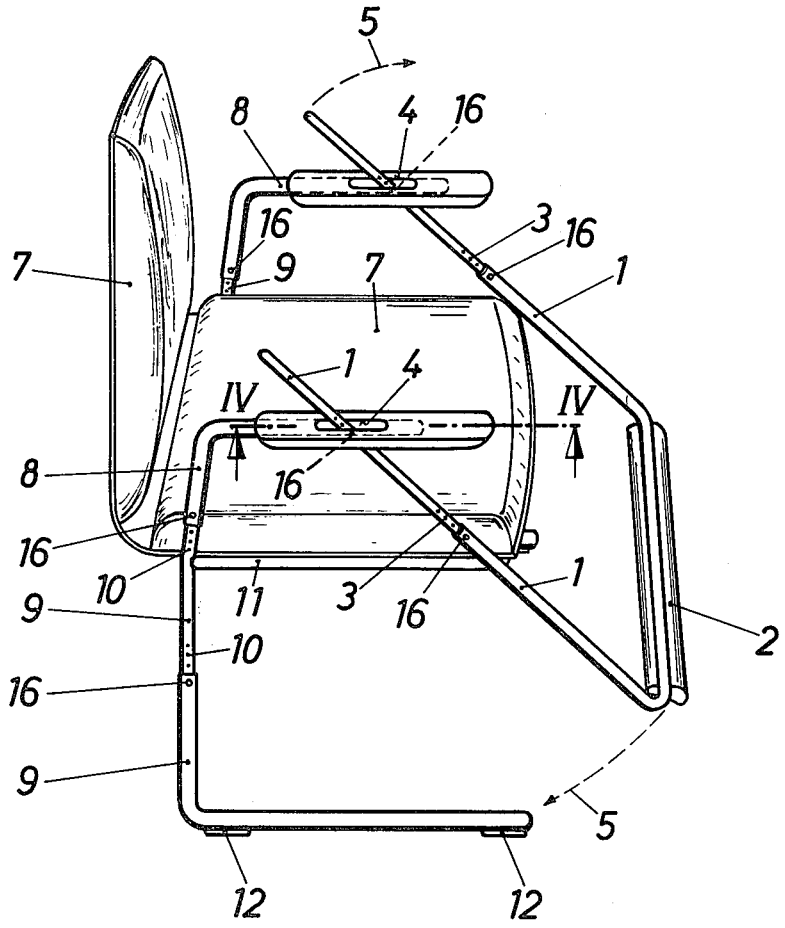
FIG. 1 shows a knee bending device in oblique view.

The knee bending device shown in FIG. 1 is in the form of a simple chair with an upholstered seat and back support 7, and tubular steel legs 9 and arm-rests 8. The seat part is supported by a tubular steel frame member 11 which is bent in approximately U-shaped manner so that it forms a cross member below the seat.

The arm-rests 8 each have an elongate hole 4, through which a respective limb of a U-shaped swivel stirrup 1 engages. Each limb has several apertures, through which a pivot 16 can be passed and which is selectively insertable in a plurality of slots of a stop rail 6 (in accordance with the embodiment of FIG. 2) or in apertures 6′ of the arm-rest (in accordance with the embodiment of FIG. 4).

A patient wishing to make his hitherto stiff leg completely functional, by repeated knee bends, sits down in the chair and supports his back against the back support 7. The central part of the swivel stirrup 1 is placed onto the top of the foot of the stiff leg. Then the patient grasps the free ends of the parallel limbs of the U-shaped swivel stirrup 1 and pushes them away in the direction of the arrow 5, at the same time the foot being moved by the stirrup 1 in the direction of the arrow 5 towards the chair. This procedure can be repeated at arbitrary intervals of time, in which respect an increasingly larger angle of bend is achievable. When the greatest possible angle of bend with the arms stretched is reached, then the pivot 16 is set back a few slots in the stop rail towards the patient or put back by a few apertures 6′, so that the maximum angle of bend can in this way be increased. Since, with the same maximum stretched arm length, the pivots 16, after this commutating or transposing are disposed closer to the body of the patient, also in this way the swivel movement path of the central part of the stirrup 1 is increased.

To protect the top of the foot, the central part of the stirrup 1 is advantageously provided with a suitable padding 2.

It is advisable to make the two parallel limbs of the stirrup 1 variable in length by longitudinal displacement means 3 and the arm supports as well as the chair legs variable by vertical displacement means 10 and to make them adjustable to suit different sizes of patient.

The chair can be supported on rubber pads 12 or casters which are not shown in the drawings.

The described device thus has the advantage of the simple construction of a chair and needs no further fastening means for the strapping-in of the patient and of his foot. The swivel movement can be achieved by simple movement of the swivel stirrup without any mechanical auxiliary aids such as crank gears or the like.

Also the extent of the greatest achievable angle of bend exceeds that of the known device, mentioned at the beginning.

I claim:

1. A knee bending device comprising a chair including a back support and arm rests, and a U-shaped stirrup including two substantially parallel limbs and a connecting central bar, said parallel limbs being swingable about pivots which are adjustably mounted in said arm rests, said pivots on the parallel limbs being between the ends thereof such that extensions of said limbs above the arm rests comprise hand-actuated lever arms, whereby a patient seated in said chair can exert knee bending pressure on his feet and/or legs by pressing the lever arms forward and thereby forcing the central bar downwardly.

2. A device according to claim 1, wherein said parallel limbs extend through elongate holes in said arm rests.

3. A device according to claim 1, wherein said arm rests are each provided with a stop rail having a plurality of slots into which said pivots selectively engage.

4. A device according to claim 1, wherein said arm rests each have a plurality of apertures therein for selectively receiving the pivots.

5. A device according to claim 1, wherein said parallel limbs are adjustable in length.

6. A device according to claim 1, wherein the chair legs are adjustable in height.

7. A device according to claim 1, wherein supports for said arm rests are adjustable in height.

8. A device according to claim 1, wherein said central bar of said stirrup is provided with padding at least on its underside to protect the top of a user's foot when in use.

* * * * *